US007772753B2

(12) United States Patent
Ham

(10) Patent No.: US 7,772,753 B2
(45) Date of Patent: Aug. 10, 2010

(54) ELECTRODELESS LAMP CORE ASSEMBLY INCLUDING COIL BOBBIN AND LAMP ENVELOPE PROTECTOR

(75) Inventor: Byung Il Ham, Rancho Pales Verdes, CA (US)

(73) Assignee: U.S. Energy Technologies, Inc., Signal Hill, CA (US)

( * ) Notice: Subject to any disclaimer, the term of this patent is extended or adjusted under 35 U.S.C. 154(b) by 514 days.

(21) Appl. No.: 11/899,129

(22) Filed: Sep. 4, 2007

(65) Prior Publication Data

US 2009/0058251 A1 Mar. 5, 2009

(51) Int. Cl.

| | |
|---|---|
| ***H01J 1/50*** | (2006.01) |
| ***H01J 23/16*** | (2006.01) |
| ***H01J 17/14*** | (2006.01) |
| ***H01J 9/00*** | (2006.01) |

(52) U.S. Cl. ..... 313/160; 313/153; 313/161; 315/248; 315/44; 315/57; 315/62; 445/26; 445/23

(58) Field of Classification Search ..... 313/153–162; 315/248, 44, 57, 62

See application file for complete search history.

(56) References Cited

U.S. PATENT DOCUMENTS

| | | | | |
|---|---|---|---|---|
| 4,415,838 | A * | 11/1983 | Houkes | 315/248 |
| 5,621,280 | A * | 4/1997 | Antonis et al. | 315/248 |
| 6,175,197 | B1 * | 1/2001 | Kling | 315/248 |
| 6,433,492 | B1 * | 8/2002 | Buonavita | 315/248 |
| 6,762,550 | B2 * | 7/2004 | Itaya et al. | 313/161 |
| 2003/0062851 | A1 * | 4/2003 | Shaffer | 315/248 |

FOREIGN PATENT DOCUMENTS

| | | | |
|---|---|---|---|
| JP | 2004259689 | A * | 9/2004 |
| WO | WO 9710610 | A1 * | 3/1997 |

* cited by examiner

*Primary Examiner*—Mariceli Santiago
(74) *Attorney, Agent, or Firm*—Sheppard Mullin Richter & Hampton LLP

(57) ABSTRACT

In an electrodeless lamp, at least one core assembly is coupled to a tubular lamp envelope. The core assembly includes a lamp envelope protector disposed over an outer surface of the lamp envelope, and a core member surrounding the lamp envelope at a core mounting location such that lamp envelope protector is disposed between the core member and the lamp envelope. The core assembly further includes a coil bobbin coupled to the core member, and a coil wounded around the coil bobbin.

25 Claims, 9 Drawing Sheets

ELECTRODELESS LAMP CORE ASSEMBLY INCLUDING COIL BOBBIN AND LAMP ENVELOPE PROTECTOR

BACKGROUND OF THE INVENTION

1. Field of the Invention

The present invention generally relates to electrodeless lamps, and more particularly, to a core assembly for electrodeless lamps.

2. Description of the Related Art

Various types of electrode lamps are available that have lamp electrodes disposed within a lamp envelope to deliver electrical power to the lamp. For example, in electrode type fluorescent lamps and incandescent lamps, electrical power is delivered to a lamp through electrical power flowing between the lamp electrodes.

Recently, there have been introduced various types of electrodeless lamps that do not require electrodes disposed within the lamp envelope. One of the advantages of not using electrodes in electrodeless type lamps is that the life of the lamp can be substantially extended since the use of an electrode is a major factor in limiting the life of electrode type lamps.

BRIEF SUMMARY OF EMBODIMENTS THE INVENTION

Described herein are embodiments of an electrodeless lamp that includes a lamp envelope and at least one core assembly coupled to the lamp envelope. The core assembly includes a lamp envelope protector disposed over an exterior surface of the lamp envelope, and a core member surrounding the lamp envelope at a core mounting location such that lamp envelope protector is disposed between the lamp envelope and at least a portion of the core member. The core assembly further includes a coil bobbin coupled to the core member, and a coil wounded around the coil bobbin.

BRIEF DESCRIPTION OF THE DRAWINGS

Embodiments of the invention are illustrated by way of example and not by way of limitation in the figures of the accompanying drawings in which like references indicate similar elements. It should be noted that the references to "an embodiment" or "one embodiment" of this disclosure are not necessarily to the same embodiment, and such references mean at least one.

DETAILED DESCRIPTION OF THE INVENTION

In the following description, specific details are set forth in order to provide a thorough understanding of various embodiments of the present invention. However, it will be apparent to one skilled in the art that embodiments of the present invention may be practiced without these specific details. In other instances, well-known circuits, components, structures and techniques have not been shown in detail in order to avoid obscuring embodiments of the present invention. It should be noted that, as used in the description herein and the claims, the meaning of "in" includes "in" and "on".

Figure 1:
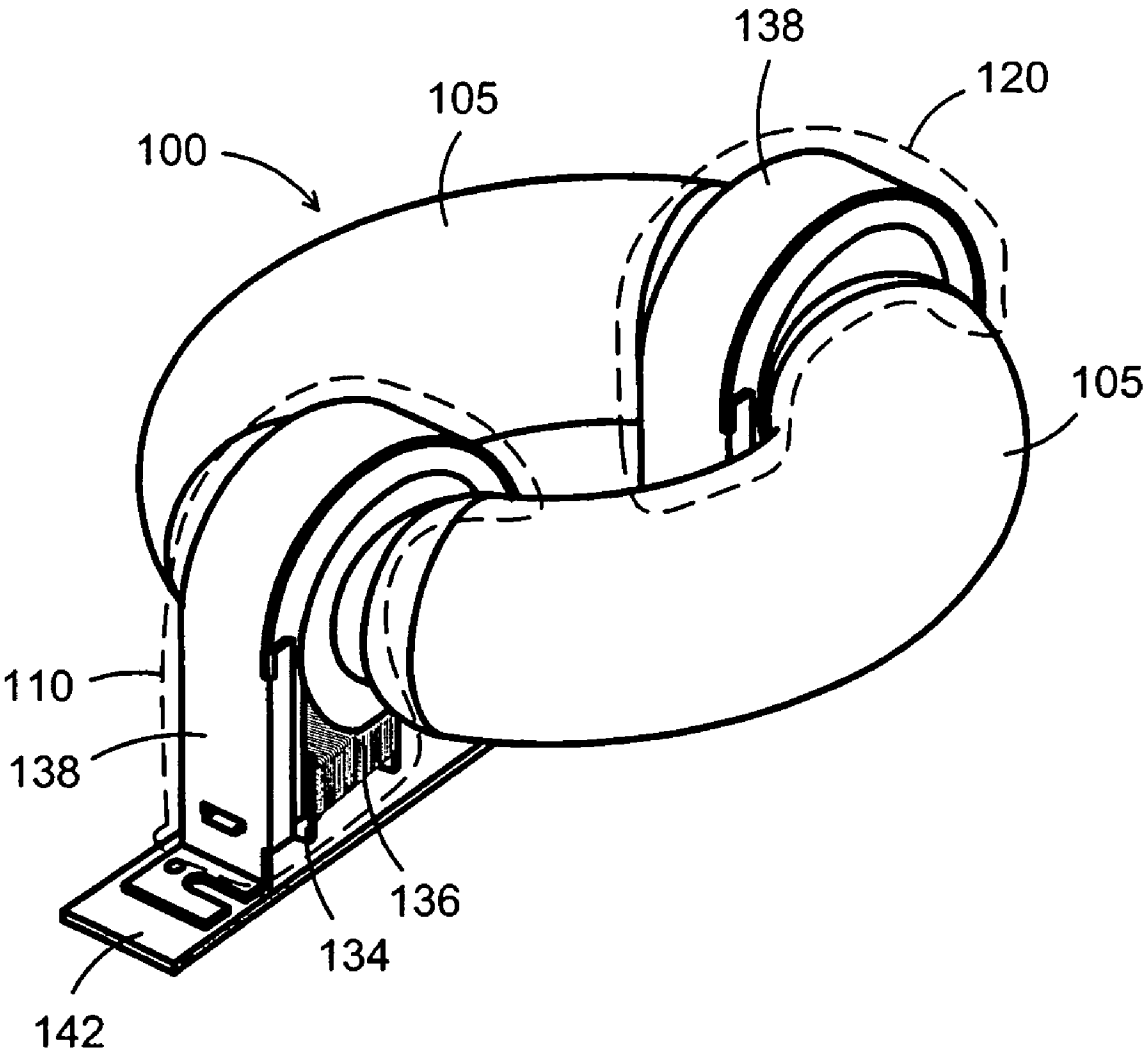
FIG. 1 is a diagrammatic perspective view of an electrodeless lamp according to an embodiment of the present invention.

FIG. 1 illustrates an electrodeless lamp according to an embodiment of the present invention. The lamp 100 generally includes a lamp envelope 105, a first core assembly 110 encircling the lamp envelope at a first core mounting location, and a second core assembly 120 encircling the lamp envelope at a second core mounting location. In an embodiment, the lamp envelope 105 is a tubular lamp envelope formed in a closed loop. In an embodiment, the tubular lamp envelope 105 contains a medium (e.g., argon gas, krypton gas, mercury vapor, etc) capable of generating ultraviolet (UV) radiation. The tubular lamp envelope 105 may further include a layer of phosphors disposed on the inner surface thereof to convert the UV radiation into visible light. While the tubular lamp envelope 105 illustrated in FIG. 1 has an overall circular shape, the lamp 100 can employ a tubular lamp envelope having any other suitable shape or size, including a rectangular shaped lamp envelope.

Figure 2:
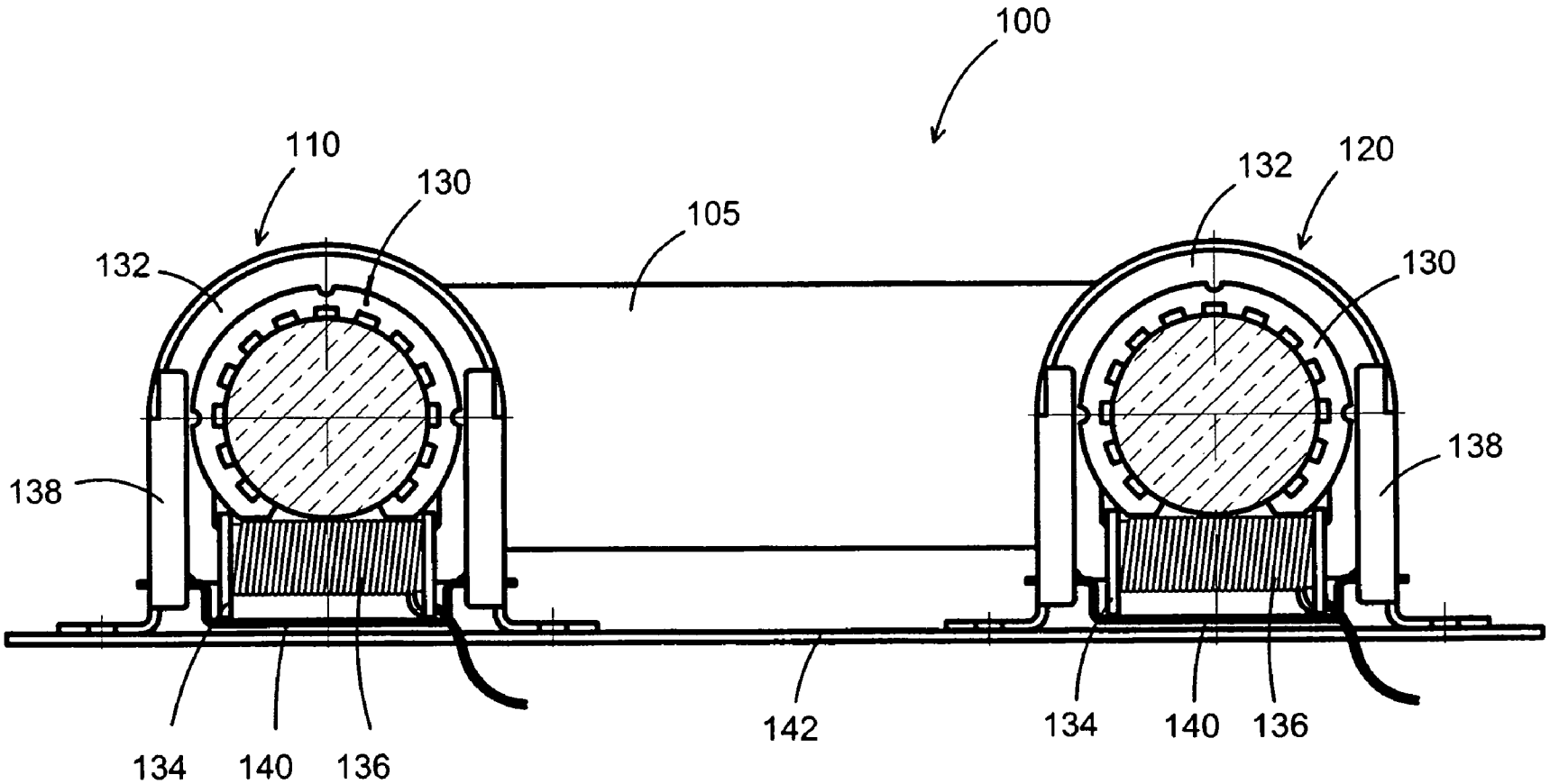
FIG. 2 is an elevational cross-sectional view of the electrodeless lamp shown in FIG. 1.

As seen by referring to FIG. 2, which shows an elevational cross-section view of the electrodeless lamp shown in FIG. 1, each of the core assemblies 110, 120 generally includes a lamp envelope protector 130 disposed over an exterior surface of the lamp envelope 105, a core member 132 surrounding the lamp envelope at a core mounting location such that lamp envelope protector is disposed between the lamp envelope and at least a portion of the core member, a coil bobbin 134 coupled to the core member, and a coil 136 wounded around the coil bobbin. The power to generate light is transferred from the outside of the lamp envelope 105 by use of electromagnetic fields. In this regard, the electrodeless lamp 100 further includes a ballast circuit configured to generate high frequency power (e.g. high frequency current) to drive the induction coil 136 wounded around the coil bobbins 134 of each of the core assemblies 110, 120. In operation, the high frequency current generated by the ballast circuit flows through the induction coil 136 wound around the cores 132 of the first core assembly 110 and the second core assembly 120, producing inductive electromagnetic fields to excite and maintain the interaction between the discharge gas (e.g., electrons, phosphors) contained in the lamp envelope 105.

Figure 3:
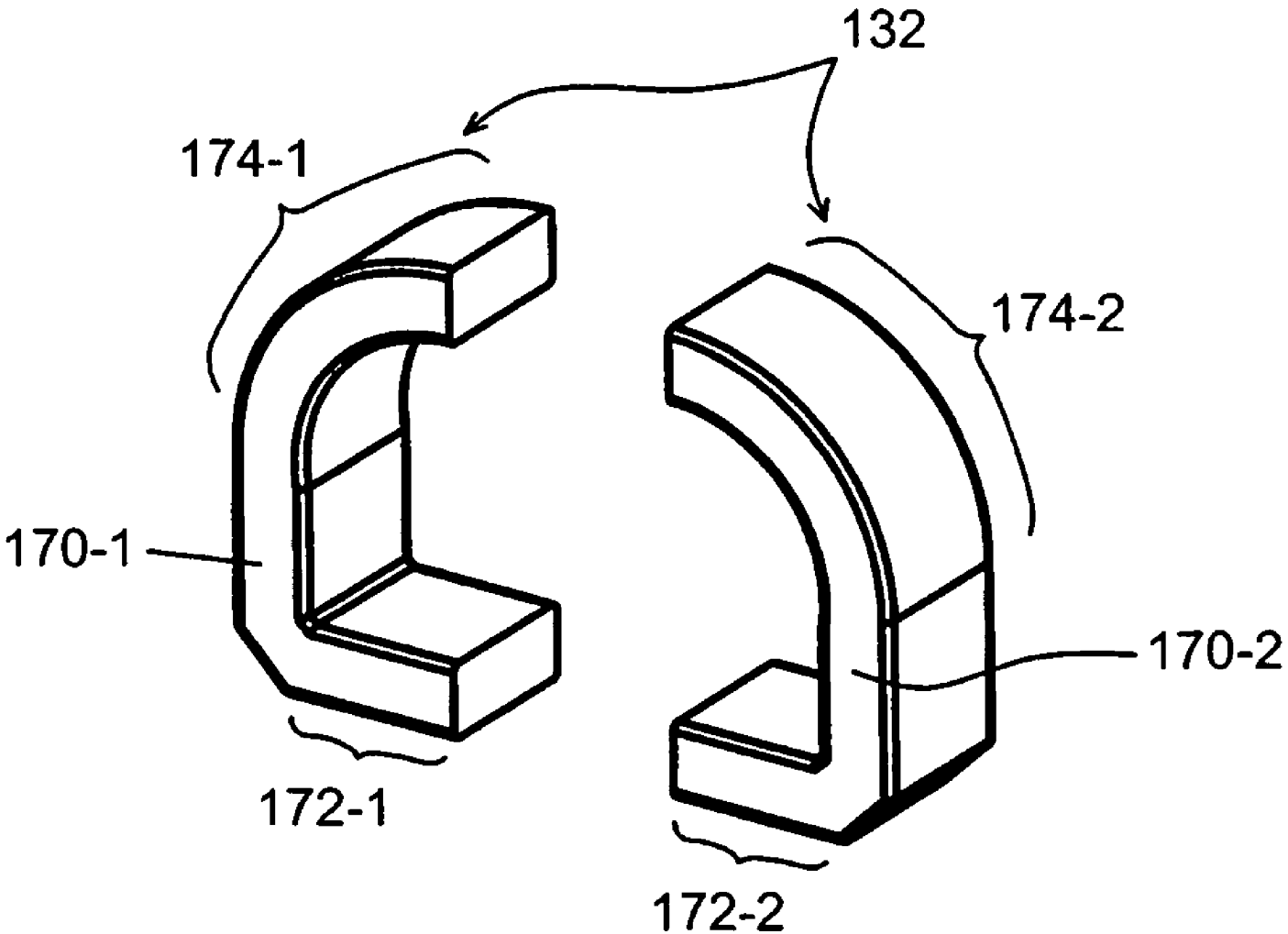
FIG. 3 is a diagrammatic perspective view of a core member comprising a first core section and a second core section according to an embodiment of the present invention.

FIG. 3 illustrates the core member 132, included in each of the core assemblies 110, 120, according to an embodiment of the present invention. In an embodiment shown in FIG. 3, the core member 132 comprises two separate parts; namely, a first core section 170-1 and a second core section 170-2, configured for positioning in an opposed, mirror relationship about the tubular lamp envelope 105. During assembly of the lamp 100, the first core section 170-1 and the second core section 170-2 are mounted together to encircle the lamp envelope 105 at a core mounting location using a core band 138 (shown in FIGS. 1 and 2) and a retaining member 140 (e.g., spring member) (shown in FIG. 2). In the illustrated embodiment, the first core section 170-1 and the second core section 170-2 when mounted together form a closed-loop body having an approximately D-shaped core configuration, including curved portions 174-1, 174-2 and straight portions 172-1, 172-2.

Figure 4:
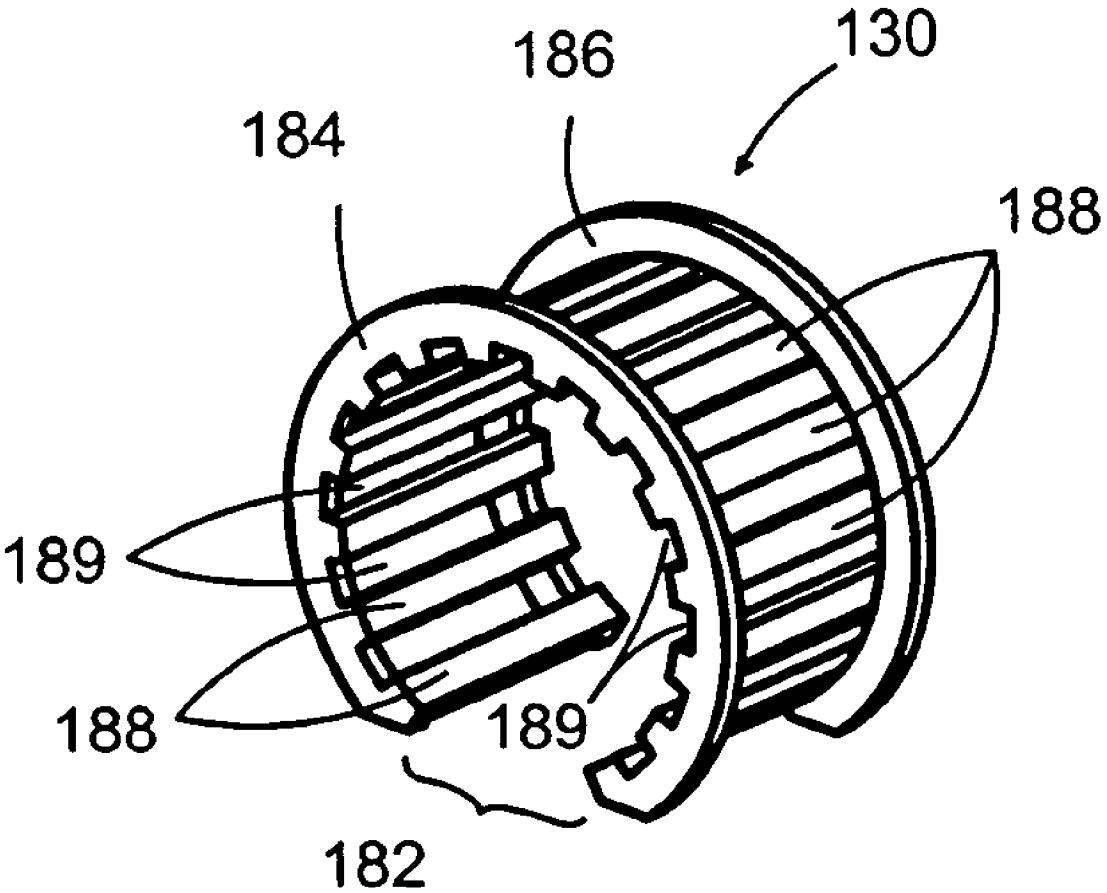
FIG. 4 is a diagrammatic perspective view of a lamp envelope protector according to an embodiment of the present invention.

FIG. 4 illustrates the lamp envelope protector 130, included in each of the core assemblies 110, 120, according to an embodiment of the present invention. In an embodiment shown in FIG. 4, the lamp envelope protector 130 comprises a flexible partial tubular member sized and shaped to partially surround the lamp envelope 105. The lamp envelope protector 130 has an opening 182 oriented parallel relative to a longitudinal axis of the tubular member such that manual spreading of the opening 182 allows increase in the opening of the partial tubular member to permit receiving of the tubular lamp envelope 105 within the partial tubular member structure. According to an aspect of an embodiment, the lamp envelope protector 130 partially surrounds the lamp envelope 105 such that the lamp envelope protector is not disposed between the lamp envelope 105 and at least a portion of the core member 132 where the coil bobbin 134 is disposed.

The lamp envelope protector 130 includes a first flange 184 and a second flange 186 integrally formed at opposite ends of the tubular member. The distance between the first flange 184 and the second flange 186 of the lamp envelope protector 130 corresponds with a width of the core member 132 such that the core member is capable of being retained between the first flange 184 and the second flange 186. The lamp envelope protector 130 is constructed by integrally forming a plurality of longitudinal elements 188 between the first flange 184 and the second flange 186 such that a plurality of air gaps 189 are formed between the plurality of longitudinal elements 188 to enable air to flow between the lamp envelope 105 and the core member 132. In an embodiment, the lamp envelope protector 130 is made of a plastic material, and in a preferred embodiment, the envelope protector 130 is made of a nylon material.

By employing lamp envelope protectors 130, as shown and described with reference to FIG. 4, in manufacturing of electrodeless lamps, a number of advantages may be achieved. For example, the lamp envelope protector 130 protects the glass lamp envelope 105 from being damaged by the metallic core member 132 by preventing the core member 132 from making direct contact with the outer surface of the lamp envelope 105. Moreover, the use of the lamp envelope protector 130 enables the core member 132 to be tightly mounted to the lamp envelope 105 so as to reduce the chance of the core member 132 moving and/or vibrating with respect to the lamp envelope 105 during installation or transportation of the lamp 100. Furthermore, the lamp envelope protector 130 helps to dissipate heat between the lamp envelope 105 and the core member 132 by enabling air to circulate through the air gaps 189 formed in the lamp envelope protector 130. In contrast, in at least one conventional type of electrodeless lamp, tapes are wrapped around a lamp envelope before mounting a metal core member. Consequently, in such conventional electrodeless lamp type, the core member may move with respect to the lamp envelope, possibly causing damage to the glass lamp envelope. Furthermore, the tapes wrapped around the lamp envelope can harden and deteriorate over time due to the heat generated by the lamp envelope.

Figure 5:
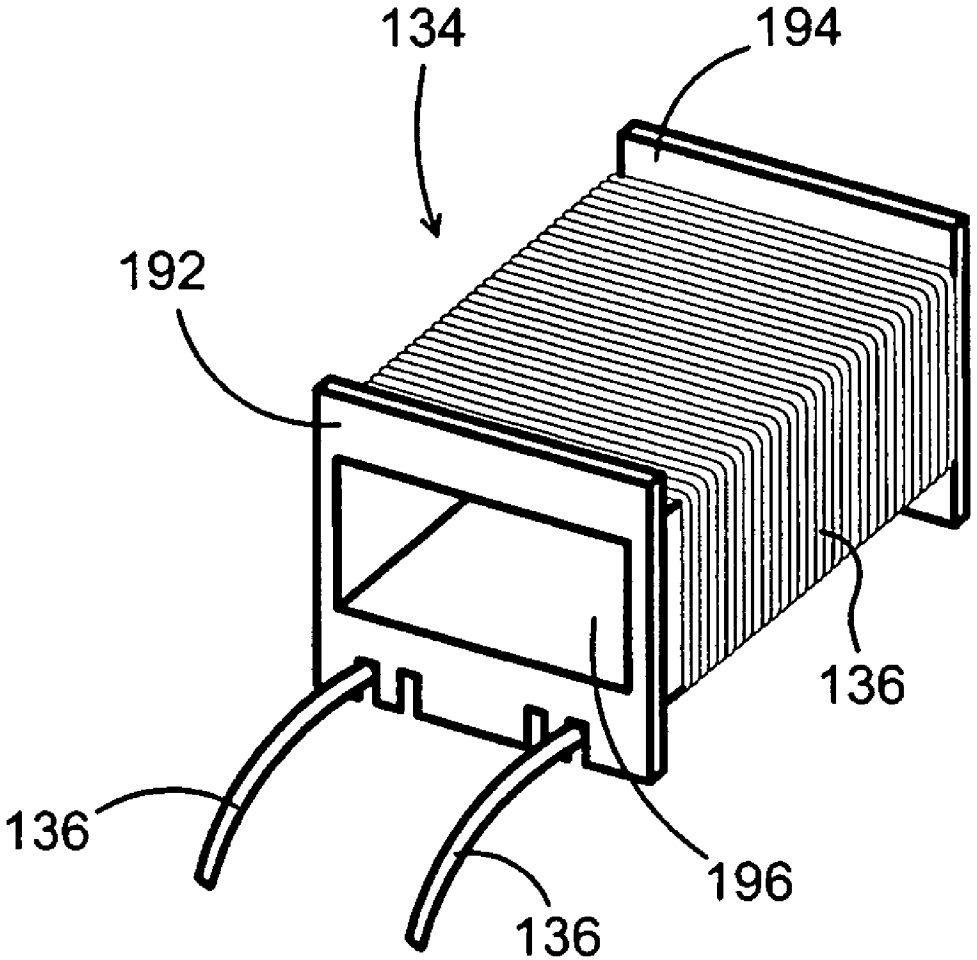
FIG. 5 is a diagrammatic perspective view of a coil bobbin having a coil wounded around its outer periphery according to an embodiment of the present invention.

FIG. 5 illustrate the coil bobbin 134, included in each of the core assemblies 110, 120, according to an embodiment of the present invention. In an embodiment shown in FIG. 5, the coil bobbin 134 comprises a hollow body for receiving a coil winding around its outer periphery. The hollow body of the coil bobbin 134 has a pair of end flanges 192, 194 formed at each respective ends of the hollow body to form a spool-like structure. The hollow body of the coil bobbin 134 has a tunnel opening 196 extending through the hollow body. The tunnel opening 196 has cross-section dimension (e.g., height and width) corresponding to cross-section dimensions (e.g., height and width) of the core member 132 such that portions (e.g. straight portions 172-1, 172-2) of the core member 132 can be inserted through the tunnel opening 196 of the core bobbin 134. In an embodiment, the tunnel opening 196 has a rectangular cross-section taken perpendicular to an axis of the tunnel opening to correspond with the core member 132 having a rectangular cross-section. During assembly of the lamp 100, the straight portions 172-1, 172-2 of the core member 132 are inserted through the opening 196 formed in the hollow body of the coil bobbin 134. In an embodiment, the coil bobbin 134 is made of a plastic material, and, in a preferred embodiment, the coil bobbin 134 is made of a nylon material. By incorporating a coil bobbin in an electrodeless lamp configuration, a number of advantages may be achieved. For example, a coil winding machine can be used to wind a coil onto the coil bobbin 134. By doing so, the productivity of manufacturing of electrodeless lamps may be increased. Additionally, by using a coil winding machine, an accurate number of coil turns may be wound on each coil bobbin 134, thereby providing consistency.

Figure 7A:
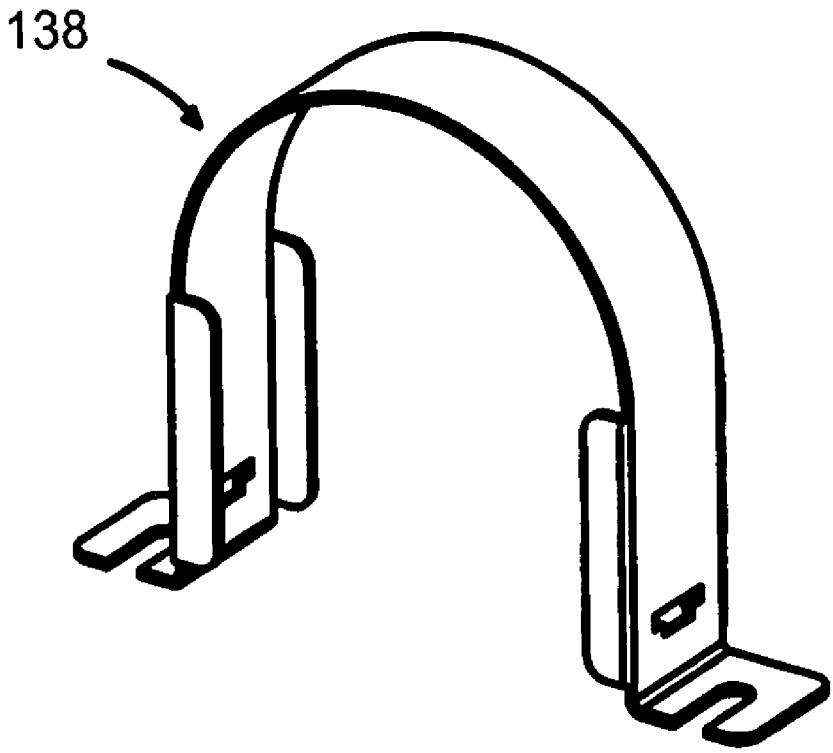
FIG. 7A is a diagrammatic perspective view of a core band according to an embodiment of the present invention.
Figure 7B:
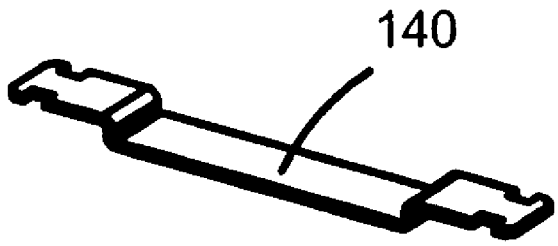
FIG. 7B is a diagrammatic perspective view of a spring member according to an embodiment of the present invention.

Each respective core assembly further includes a core band 138 (shown in FIGS. 1, 2 and 7A) configured to surround a portion of the core member 132 to hold the first core section 170-1 and the second core section 170-2 together around the lamp envelope 105, and a retaining member (spring element) 140 (shown in FIGS. 2 and 7B) engaged with the core band 138 to secure the core member 132 disposed within an interior of the core band 138 onto a lamp support structure 142 (shown in FIGS. 1 and 2).

Figure 9:
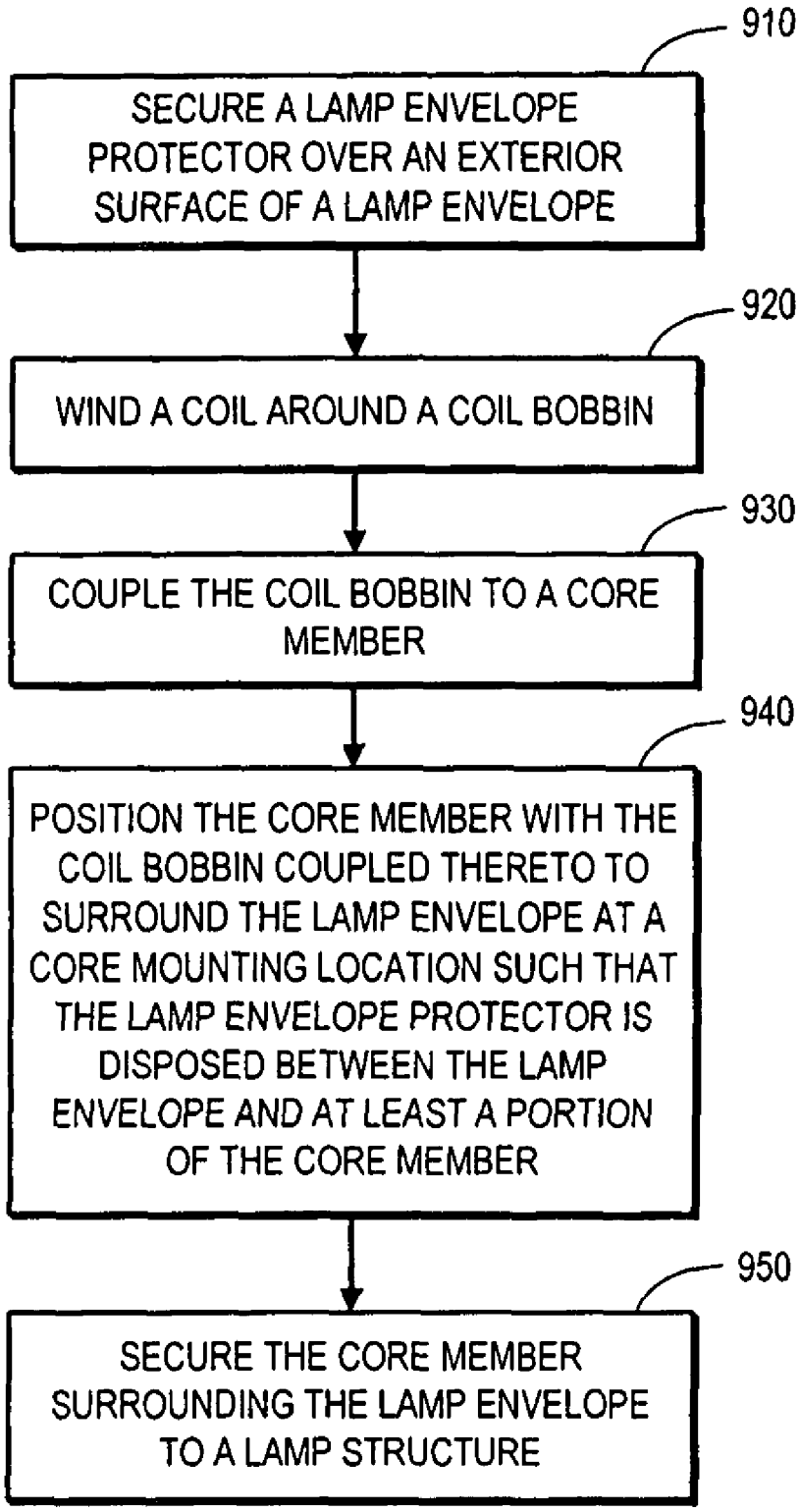
FIG. 9 is a flowchart diagram of a process of assembling an electrodeless lamp according to an embodiment of the present invention

FIG. 9 shows general operations involved in a process of assembling the electrodeless lamp 100 according to an embodiment of the present invention. In block 910, the lamp envelope protector 130 is secured over an exterior surface of the lamp envelope 105 at a core mount location. As discussed above, in an embodiment, the lamp envelope protector 130 comprises a flexible partial tubular member to partially surround the lamp envelope 105. The partial tubular member of the lamp envelope protector 130 having an opening 182 (shown in FIG. 4) oriented parallel relative to a longitudinal axis of the tubular member. Accordingly, the lamp envelope protector 130 can be placed on an exterior surface of the lamp envelope 105 by manually spreading of the opening 182 of the partial tubular member, and receiving the lamp envelope 105 within the partial tubular member.

In block 920, the coil 136 is wound around the coil bobbin 134. Then, in block 930, the coil bobbin 134 is coupled to the core member 132 including the first core section 170-1 and the second core section 170-2. As shown in FIG. 5, the coil bobbin 134 comprises a hollow body having a tunnel opening 196 extending therethrough. The tunnel opening 196 of the coil bobbin 134 has a cross-section corresponding to a cross-section of the core member 132. Accordingly, the coil bobbin 134 can be coupled to the core member 132 by inserting the straight portion 172-1 (shown in FIG. 3) of the first core section 170-1 into one end of the tunnel opening 196 of the coil bobbin 134, and inserting the straight portion 172-2

Figure 8:
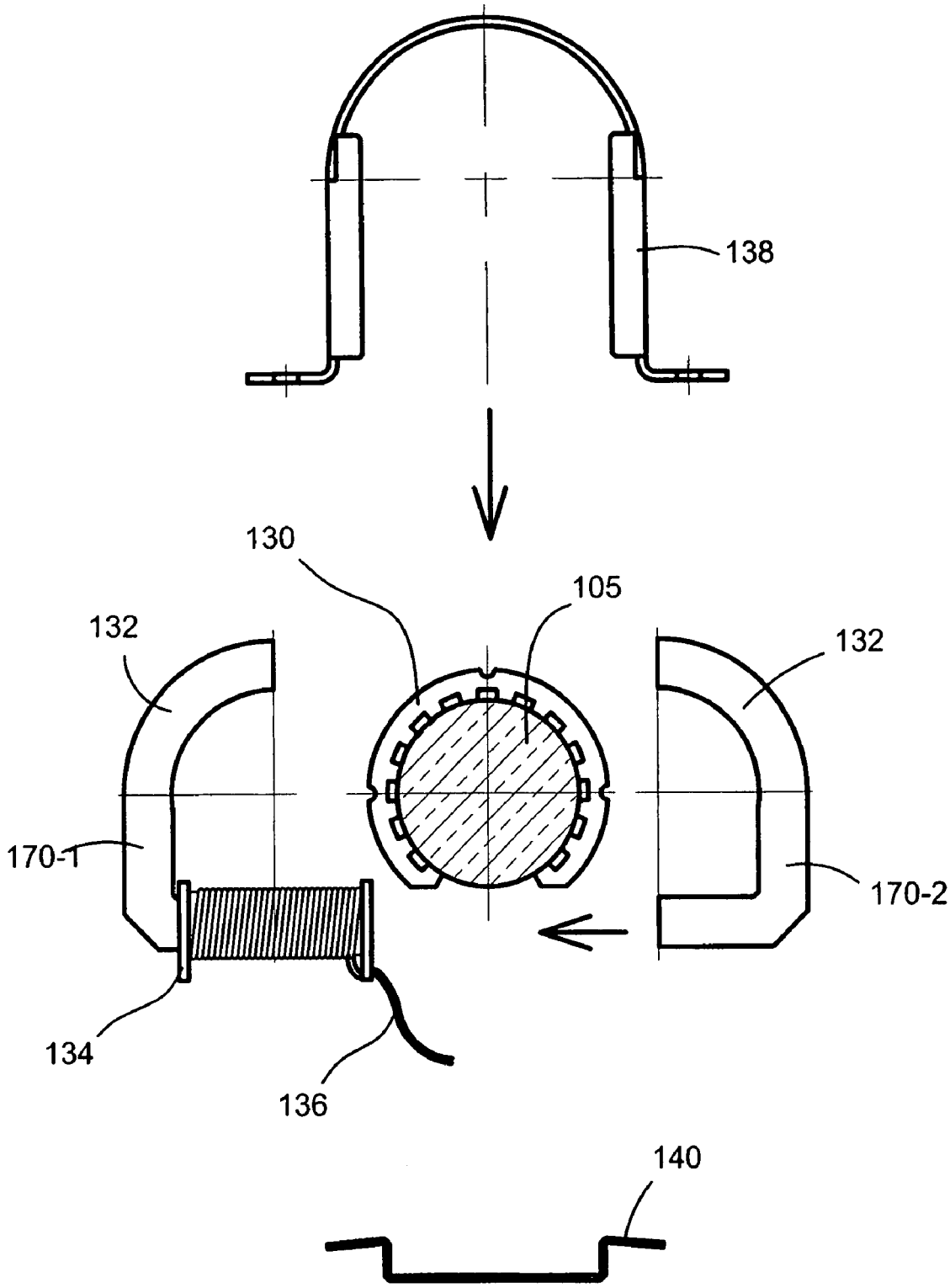
FIG. 8 is an exploded view of a core assembly according to an embodiment of the present invention.

(shown in FIG. 3) of the second core section 170-1 into the other end of the tunnel opening 196 of the bobbin 134, as shown in FIG. 8.

Figure 6A:
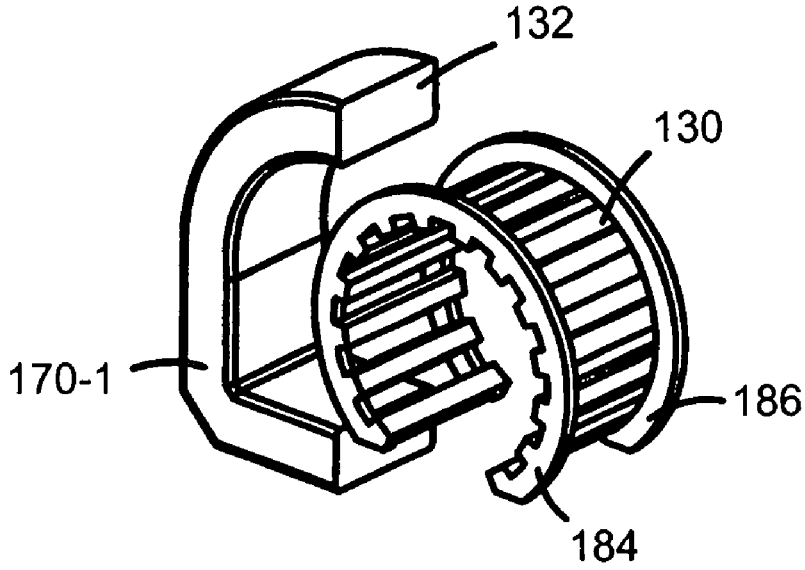
FIG. 6A is a diagrammatic perspective view of the lamp envelope protector and one of the core sections according to an embodiment of the present invention.
Figure 6B:
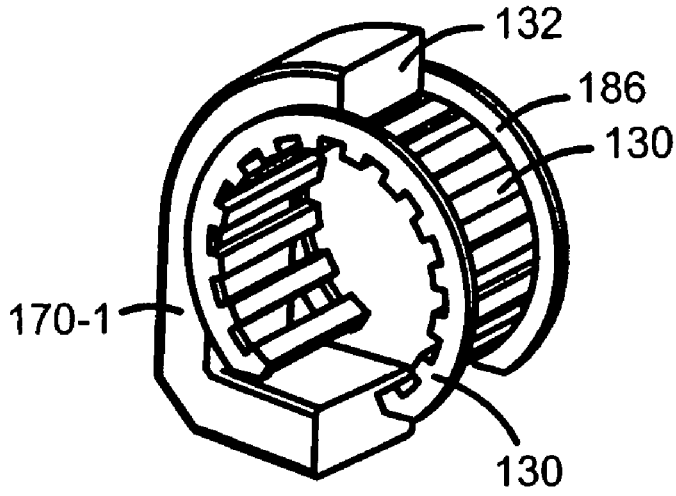
FIG. 6B is a diagrammatic perspective view of the core section shown in FIG. 6A disposed around the lamp envelope protector according to an embodiment of the present invention.

In block 940, the first core section 170-1 and the second core section 170-2 of the core member 132 with the coil bobbin 134 coupled thereto is positioned to surround the lamp envelope 105 at a core mounting location such that the lamp envelope protector 130 is disposed between the lamp envelope 105 and at least a portion of the core member 130 (as shown in FIGS. 6A, 6B and 8). In block 950, once the core member 132 with the coil bobbin 134 coupled thereto has been properly positioned around the lamp envelope 105, the first core section 170-1 and the second core section 170-2 of the core member 132 are secured to the lamp support structure 142 (shown in FIG. 1). This is accomplished in an embodiment by placing the core band 138 (shown in FIG. 7A) around a portion of the first core section 170-1 and the second core section 170-2 of the core member 132, and engaging the spring member 140 (shown in FIG. 7B) to the core band 138 such that the core member 132 placed within an interior of the core band 138 is secured to the lamp support structure 142 (as shown in FIGS. 1 and 8).

While the foregoing embodiments of the invention have been described and shown, it is understood that variations and modifications, such as those suggested and others within the spirit and scope of the invention, may occur to those skilled in the art to which the invention pertains. The scope of the present invention accordingly is to be defined as set forth in the appended claims.

What is claimed is:

1. An electrodeless lamp comprising:

a lamp envelope;

at least one core assembly coupled to the lamp envelope, the core assembly including a lamp envelope protector disposed over an exterior surface of the lamp envelope, a core member surrounding the lamp envelope at a core mounting location such that lamp envelope protector is disposed between the lamp envelope and at least a portion of the core member, a coil bobbin coupled to the core member, and a coil wounded around the coil bobbin; and a ballast circuit coupled to the coil wounded around the core member.

2. The electrodeless lamp of claim 1, wherein the lamp envelope is a tubular lamp envelope formed in a closed loop, the core member has a closed-loop body including a curved portion and a straight portion, the coil bobbin has a hollow body having an opening extending through the hollow body, and the straight portion of the core member is inserted through the opening formed in the hollow body of the coil bobbin.

3. The electrodeless lamp of claim 1, wherein the core member comprises two separate parts mounted together to encircle the lamp envelope at the core mounting location, and wherein the two separate parts comprise a first core section and a second core section configured for positioning in an opposed, mirror relationship about the tubular lamp envelope.

4. The electrodeless lamp of claim 1, wherein the lamp envelope protector comprises a flexible partial tubular member to partially surround the lamp envelope to prevent the core member from making direct contact with the outer surface of the lamp envelope, the partial tubular member having an opening oriented parallel relative to a longitudinal axis of the tubular member such that manual spreading of the opening enables the lamp envelope to be received within the partial tubular member, and wherein the lamp envelope protector partially surrounds the lamp envelope such that the lamp envelope protector is not disposed between the lamp envelope and at least a portion of the core member where the coil bobbin is disposed.

5. The electrodeless lamp of claim 4, wherein the flexible tubular member further includes a first flange and a second flange integrally formed at opposite ends of the tubular member, and wherein a distance between the first flange and the second flange corresponds with a width of the core member such that the core member is capable of being retained between the first flange and the second flange of the lamp envelope protector.

6. The electrodeless lamp of claim 4, wherein the partial tubular member is constructed by integrally forming a plurality of longitudinal elements between the first flange and the second flange, wherein a plurality of spaces are formed between the plurality of elements to enable air to flow between the lamp envelope and the core member.

7. The electrodeless lamp of claim 1, wherein the coil bobbin comprises a hollow body having a tunnel opening extending therethrough, the tunnel opening having a cross-section corresponding to a cross-section of the core member.

8. The electrodeless lamp of claim 1, wherein the coil bobbin and the lamp protector member are made of a plastic material.

9. The electrodeless lamp of claim 1, further comprising:

a core band configured to surround a portion of the core member to hold the first core section and the second core section together around the lamp envelope; and a retaining element engaged with the core band to retain the core member within an interior of the core band.

10. A method of assembling an electrodeless lamp having a lamp envelope and at least one core assembly coupled to the lamp envelope, the method comprising:

placing a lamp envelope protector on an exterior surface of the lamp envelope;

winding a coil around a coil bobbin;

coupling the coil bobbin to a core member including a first core section and a second core section;

positioning the first core section and the second core section of the core member with the coil bobbin coupled thereto to surround the lamp envelope at a core mounting location of the lamp envelope such that lamp envelope protector is disposed between the lamp envelope and at least a portion of the core member; and securing the core member with the coil bobbin coupled thereto and positioned around the lamp envelope to a lamp structure.

11. The method of claim 10, wherein securing the core member comprises:

placing a core band around a portion of the core member; and engaging a retaining member to the core band such that the core member placed within an interior of the core band is secured to the lamp structure.

12. The method of claim 10, wherein the lamp envelope protector comprises a flexible partial tubular member to partially surround the lamp envelope, the partial tubular member having an opening oriented parallel relative to a longitudinal axis of the tubular member.

13. The method of claim 12, wherein placing the lamp envelope protector on an exterior surface of the lamp envelope comprises:

manually spreading of the opening of the partial tubular member; and receiving the lamp envelope within the partial tubular member.

14. The method of claim 10, wherein the coil bobbin comprises a hollow body having a tunnel opening extending therethrough, the tunnel opening having a cross-section corresponding to a cross-section of the core member.

15. The method of claim 14, wherein the coupling the coil bobbin to the core member comprises:

inserting a portion of the first core section into the tunnel opening of the coil bobbin; and inserting a portion of the second core section into the tunnel opening of the bobbin.

16. A core assembly for use with an electrodeless lamp having a tubular lamp envelope, the core assembly comprising:

a lamp envelope protector configured to be disposed over an exterior surface of the tubular lamp envelope;

a core member configured to surround the tubular lamp envelope at a core mounting location such that lamp envelope protector is disposed between the core member and the lamp envelope;

a coil bobbin having a hollow body in which a portion of the core member is disposed; and a coil wounded around the coil bobbin.

17. The core assembly of claim 16, wherein the core member has a closed-loop body including a curved portion and a straight portion.

18. The core assembly of claim 17, wherein the straight portion of the core member is inserted through an opening formed in the hollow body of the coil bobbin.

19. The core assembly of claim 16, wherein the core member comprises a first core section and a second core section that are configured for positioning in an opposed, mirror relationship about the tubular lamp envelope to form a D-shaped configuration.

20. The core assembly of claim 16, wherein the lamp envelope protector comprises a flexible partial tubular member to partially surround the lamp envelope, the partial tubular member having an opening oriented parallel relative to a longitudinal axis of the tubular member such that manual spreading of the opening enables the lamp envelope to be received within the partial tubular member.

21. The core assembly of claim 20 wherein the flexible tubular member further includes a first flange and a second flange integrally formed at opposite ends of the tubular member, and wherein a distance between the first flange and the second flange corresponds with a width of the core member such that the core member is capable of being retained between the first flange and the second flange of the lamp envelope protector.

22. The core assembly of claim 20, wherein the partial tubular member is constructed by integrally forming a plurality of longitudinal elements between the first flange and the second flange, wherein spaces are formed between the plurality of elements to enable air to flow between the lamp envelope and the core member.

23. The core assembly of claim 16, wherein the lamp protector member is configured to prevent the core member from making direct contact with the outer surface of the lamp envelope, and wherein the lamp envelope protector partially surrounds the lamp envelope such that the lamp envelope protector is not disposed between the lamp envelope and at least a portion of the coil wounded around the coil bobbin.

24. The core assembly of claim 16, wherein the hollow body of the coil bobbin has a tunnel opening extending therethrough, the tunnel opening having a cross-section corresponding to a cross-section of the core member, and wherein the coil bobbin and the lamp protector member are made of a plastic material.

25. The core assembly of claim 16, further comprising:

a core band configured to surround a portion of the core member to hold the first core section and the second core section together around the lamp envelope; and a retaining member engaged with the core band to retain the core member within an interior of the core band.

* * * * *